US012275557B2

(12) United States Patent
Bussolo Antunes et al.

(10) Patent No.: US 12,275,557 B2
(45) Date of Patent: Apr. 15, 2025

(54) SUPPORT FOR HOLDING CERAMIC FACING ELEMENTS ON A PALLET

(71) Applicants: Jean Bussolo Antunes, Pedras Grandes (BR); Diego Antunes, Pedras Grandes (BR)

(72) Inventors: Jean Bussolo Antunes, Pedras Grandes (BR); Diego Antunes, Pedras Grandes (BR)

( * ) Notice: Subject to any disclaimer, the term of this patent is extended or adjusted under 35 U.S.C. 154(b) by 0 days.

(21) Appl. No.: 18/576,131

(22) PCT Filed: Jan. 28, 2022

(86) PCT No.: PCT/BR2022/050026
§ 371 (c)(1),
(2) Date: Jan. 3, 2024

(87) PCT Pub. No.: WO2023/044547
PCT Pub. Date: Mar. 30, 2023

(65) Prior Publication Data

US 2024/0367854 A1 Nov. 7, 2024

(30) Foreign Application Priority Data

Sep. 22, 2021 (BR) ..... 202021018884-2

(51) Int. Cl.
*B65D 19/44* (2006.01)

(52) U.S. Cl.
CPC ..... *B65D 19/44* (2013.01); *B65D 2519/0081* (2013.01)

(58) Field of Classification Search
CPC .... B65D 19/16; B65D 19/44; B65D 71/0088; B65D 71/0092; B65D 71/0096;
(Continued)

(56) References Cited

U.S. PATENT DOCUMENTS 2,663,417 A * 12/1953 Kincaid ..... B65D 5/5042 217/53
2,681,733 A * 6/1954 Welshenbach ..... B65D 5/504 217/53

(Continued)

FOREIGN PATENT DOCUMENTS

BR 202016027416 6/2018
BR 202019010443 12/2020

(Continued)

OTHER PUBLICATIONS

International Search Report for PCT/BR2022/050026 dated Mar. 23, 2022.

*Primary Examiner* — Patrick D Hawn
(74) *Attorney, Agent, or Firm* — B. Aaron Schulman, Esq.; Stites & Harbison, PLLC

(57) ABSTRACT

This relates to a utility model referring to an improvement introduced in a device which is employed in the field of storage and transport of loads, particularly boxes containing ceramic plates, among other materials, which are arranged and conveyed on pallets. Whereby, the present support comprises a long and long rectangular and horizontal plate (1), in which top face and central region there is perpendicularly fixed a long rectangular and vertical plate (2); further comprising walls (P) formed by a rigid mesh, which is formed by a plurality of hollow interconnected rings (A), which present a hexagonal shape; and wherein said walls (P) are outwardly delimited by a sinuous and protruding edge (B), which protrudes horizontally towards the front rib of the support. And whereby in the front face of both walls (P) there is formed a plurality of oblique protruding ribs (N), which extend from the region of the rear edges of the vertical plate (2) to the side edges (B).

1 Claim, 6 Drawing Sheets

(58) Field of Classification Search
CPC ..... B65D 2519/0081; B65D 2519/385; B65D 2519/00368; B65D 2519/00373; B65D 2519/00378; B65D 2519/00383; B65D 2519/00388; B65D 2519/00393; Y10S 206/821
USPC ..... 206/322, 453
See application file for complete search history.

(56) References Cited

U.S. PATENT DOCUMENTS 2,684,153 A * 7/1954 Freiberg ..... B65D 5/504 217/53
3,516,538 A * 6/1970 Van Antwerpen ..... B65D 5/504 206/453
3,995,749 A * 12/1976 Haskins ..... B65D 19/44 206/821
4,165,806 A * 8/1979 Cayton ..... B65D 19/38 206/386
5,297,682 A * 3/1994 Miltenberger ..... B65D 81/056 206/453
6,029,817 A * 2/2000 Wilson, Jr. ..... B65D 85/48 206/453
6,386,376 B1 5/2002 Mendoza-Castillo et al.
7,458,553 B2 * 12/2008 Tzur ..... B65D 71/70 248/346.4
7,537,125 B2 * 5/2009 Plouchart ..... B25H 3/04 211/198
7,717,657 B2 5/2010 Clarke
8,276,782 B2 * 10/2012 Liu ..... B65D 5/5071 220/655
8,820,527 B2 * 9/2014 Chan ..... B65D 81/055 206/453
9,321,393 B2 * 4/2016 Ridgeway ..... B60P 7/14
D813,489 S * 3/2018 Frazier ..... D34/38
10,106,294 B2 * 10/2018 Böttcher ..... A47B 47/0075
11,396,399 B2 * 7/2022 Amoros ..... B65D 81/02
11,713,161 B2 * 8/2023 Servaes ..... B65D 85/48 211/41.1
2011/0062040 A1 * 3/2011 Rich ..... B65D 81/05 53/472
2013/0161218 A1 * 6/2013 Servaes ..... B65D 85/48 206/449
2014/0291187 A1 * 10/2014 Servaes ..... B65D 85/48 206/454

FOREIGN PATENT DOCUMENTS

BR 202021007111 10/2022
WO WO 0017067 3/2000

* cited by examiner

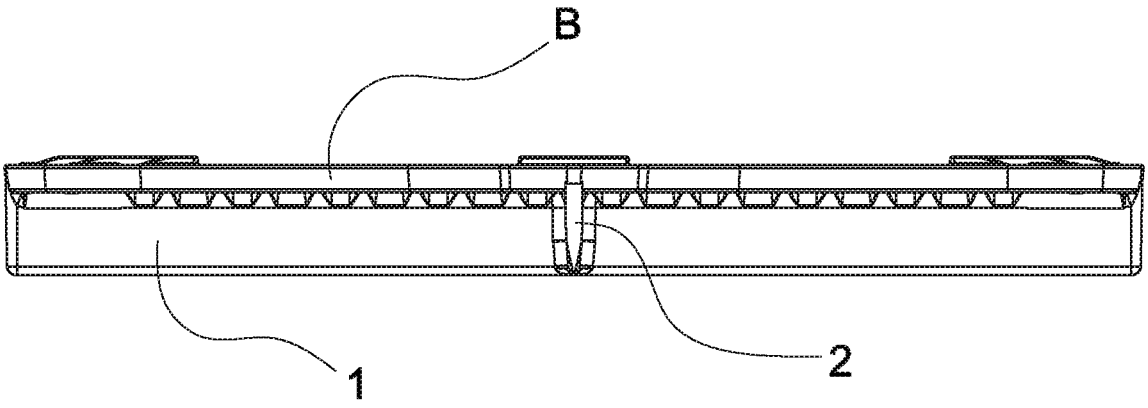
FIG 6
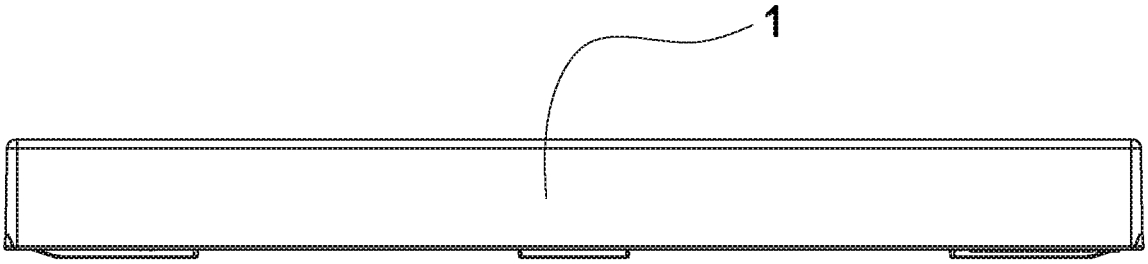
FG 7

SUPPORT FOR HOLDING CERAMIC FACING ELEMENTS ON A PALLET

FIELD OF INVENTION

The present utility model refers to an improvement introduced in a device which is employed in the field of load storage and transport, particularly boxes containing ceramic facing plates, among other materials, which are arranged and conveyed on pallets, which are wooden or steel dais, and which are caught by forklift trucks to perform material moving, loading, and unloading operations. Moreover, the present support stands out from the state of the art by presenting greater mechanical resistance to the efforts to which it is submitted during the use thereof.

STATE OF THE ART

It is known that in the field of transport and storage of goods the main objectives are practicality, agility and safety, among others. Moreover, in the case of products packaged in boxes, the use of pallets is common, whereby they are small wooden or steel structures, having a standardized size and shape, which are employed in areas of moving and transporting of loads, and can easily be lifted, moved, and repositioned, whether inside the warehouse area, or for loading the freight vehicles, such as trucks. In turn, some types of loads present some instability over the pallet, particularly during movement and transport, being emphasized in the present case the ceramic plates and related products, which slide easily over one another, since they are piled on the pallet, and may thus cause accidents and severe economic and human losses. With the purpose of solving or mitigating this problem, a device was developed some time ago, which is strategically placed between the piles of boxes deposited on the pallet, so as to hold the boxes together, avoiding the horizontal sliding movement, and which causes the spilling of the piles. This device basically comprises an element that is constituted by two metal splints fixed to each other in the shape of an inverted "T", which ends are joined by two respective slender rods, forming a triangle. Whereby, said device is positioned between two piles of boxes, which are supported on the lower horizontal segment, and are separated by the vertical segment, thus using their own weight to be horizontally supported in the vertical segment, avoiding horizontal sliding.

The object described above offers a reasonable result, however, it presents great fragility, so that, frequently, the excessive efforts end by causing the deformation thereof, and even rupture, and can result in spilling over of the piles of boxes over the pallet. Whereby, the main reason for this fragility, is the fact that the only thing that provides resistance to the horizontal efforts is just those two slender rods, between the ends of the "T" splints.

With the purpose of solving these inconveniences, patent application BR 202016027416-3 proposes a device for holding boxes in pallet which is constructed in a manner to better resist the horizontal sliding efforts of the boxes. Whereby, the main characteristic thereof is the fact that the space between the slender rods and the edges of the splints is closed by a solid wall of correspondingly triangular shape, and provided with structural reinforcement ribs, thus increasing the capacity of resisting to the efforts suffered by the device. However, the use of said object, in practice, revealed that the same employs a large amount of raw material, which increases the cost thereof, apart from the fact that this excess material which comprises the body also increases the weight thereof, negatively impacting the loading capacity of the transport vehicles, which becomes more significant in the case of large volumes of load.

Aiming at providing a reduction in mass and, consequently of the weight, the object of patent document BR 202021007111-2 was created, which is a Utility Model, wherein there is presented a device for holding materials on pallets, which distinction from the state of the art is provided by the fact that the solid and triangular wall which connects the support splints, assumes a constructive configuration defined by a rigid mesh, which is formed by a plurality of hollow and interconnected rings, thus presenting a preferred hexagonal shape, similar to honeycombs of a beehive. However, practice revealed that this constructive shape, such as proposed in the cited document, presents the inconvenience of less resistance to the efforts to which it is submitted, frequently resulting in rupture of the device, with consequent loss of efficiency, which may result in spilling over of the piles of boxes on the pallets, among other inconveniences.

OBJECTIVES OF THE INVENTION

With the purpose of solving these inconveniences the present utility model was developed, wherein there is presented a device for holding materials on the pallet, which distinction from the state of the art is provided by the fact that said wall, defined by a rigid mesh, and which is formed by a plurality of hollow interconnected rings, assumes prominent contoured edge and further, a set of cross ribs along the front face thereof, thus providing structural reinforcement regions, obtaining greater stiffness of the set and, consequently, increasing the safety provided to the load conveyed over the pallets.

DESCRIPTION OF THE DRAWINGS

For a better understanding of the present utility model, there is presented below a detailed description of same, referring to the attached drawings, wherein:

FIG. 6 illustrates the support in top view;
and
FIG. 7 illustrates the support in bottom view.

DETAILED DESCRIPTION OF THE INVENTION

Figure 1:
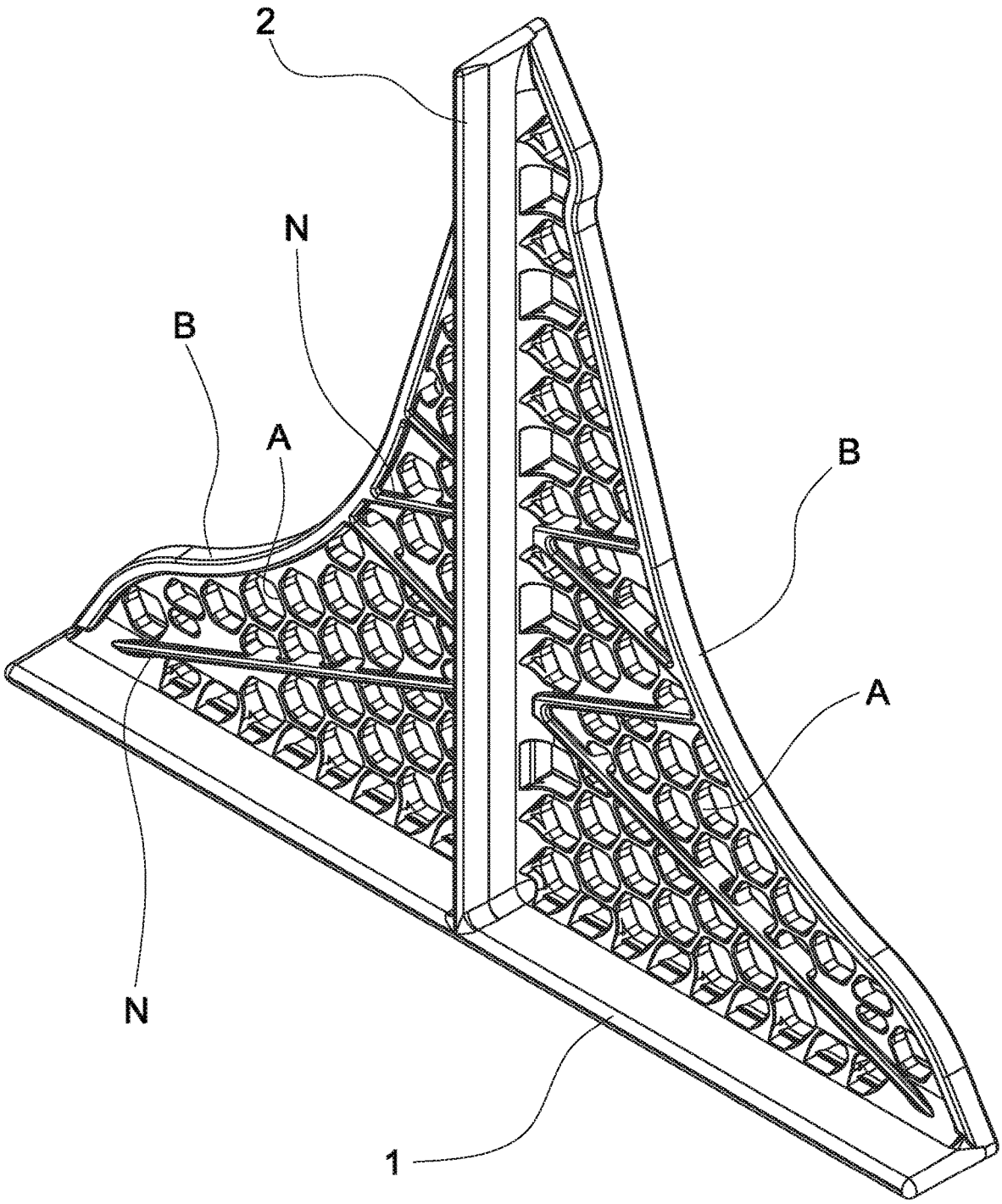
FIG. 1 illustrates the support in front perspective.
Figure 2:
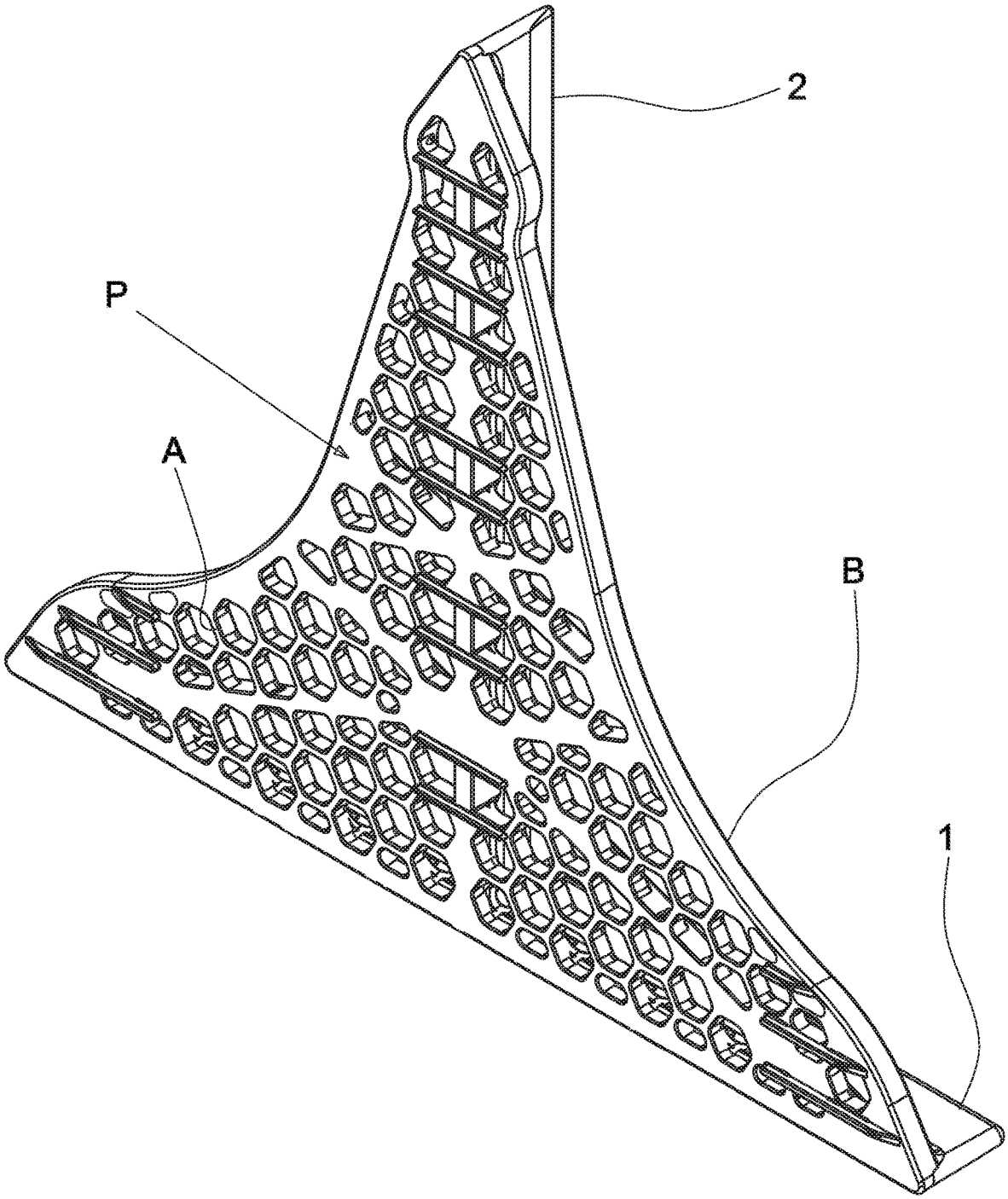
FIG. 2 illustrates the support in rear perspective.
Figure 3:
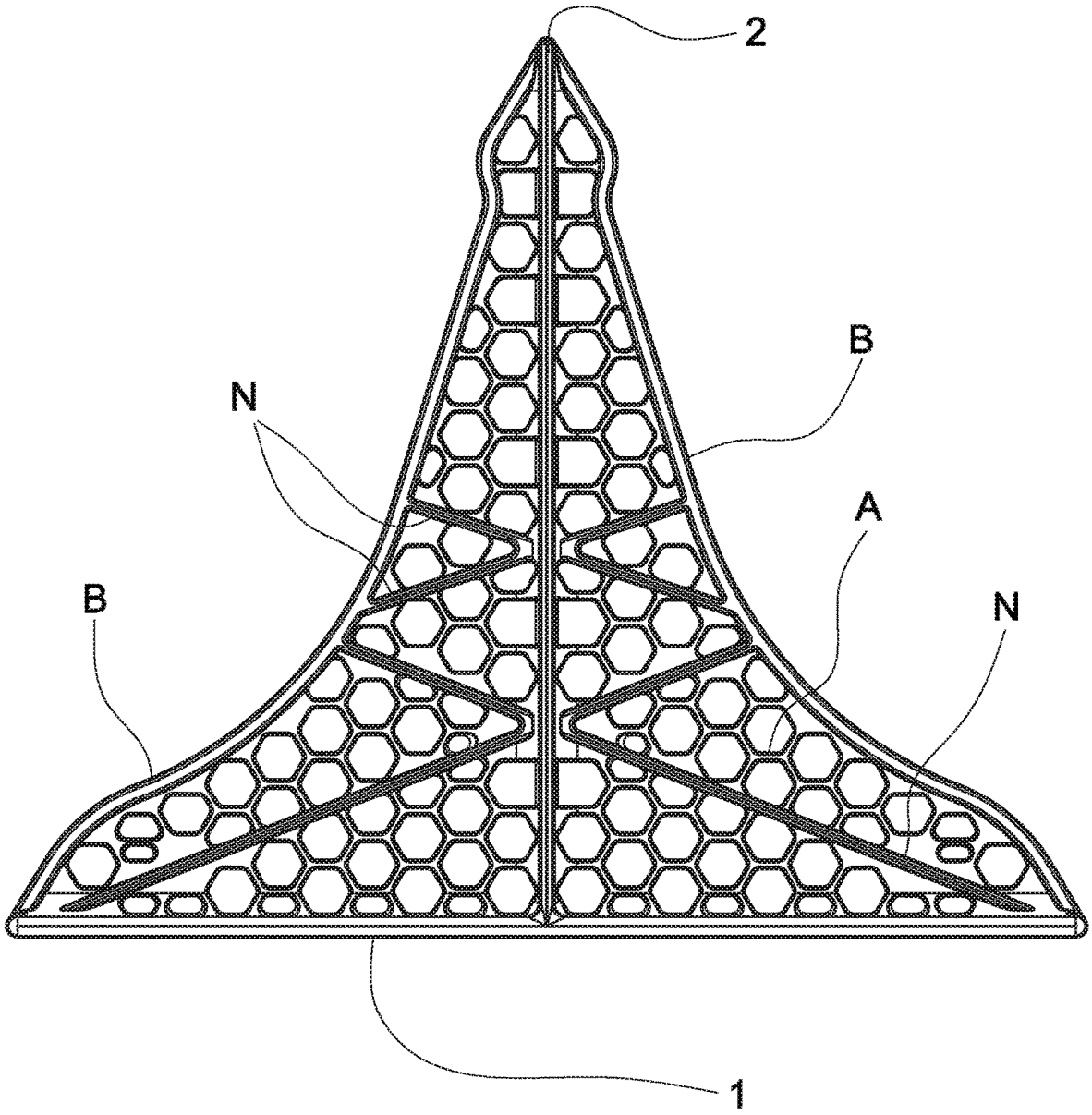
FIG. 3 illustrates the support in front view.
Figure 4:
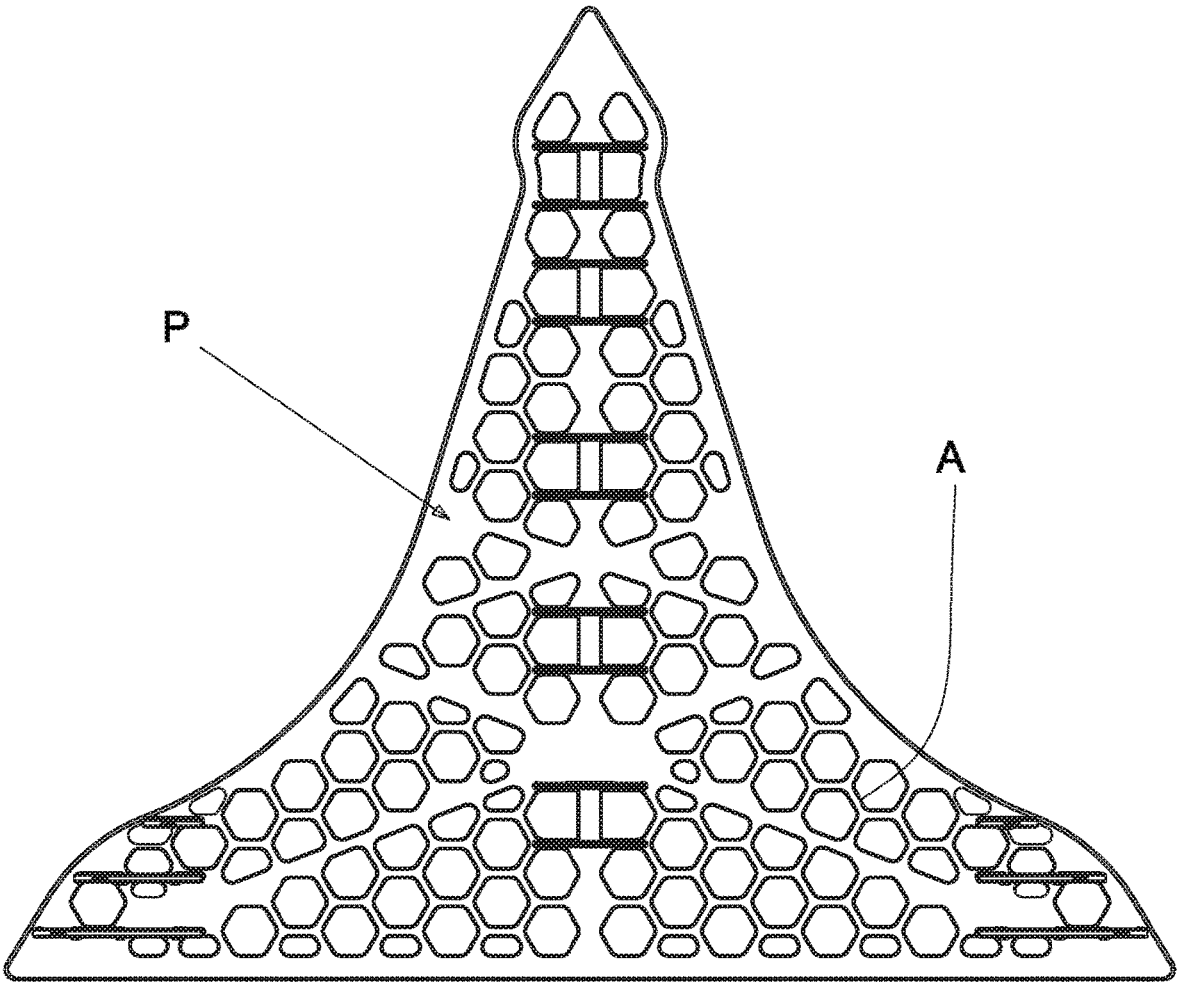
FIG. 4 illustrates the support in rear view.
Figure 5:
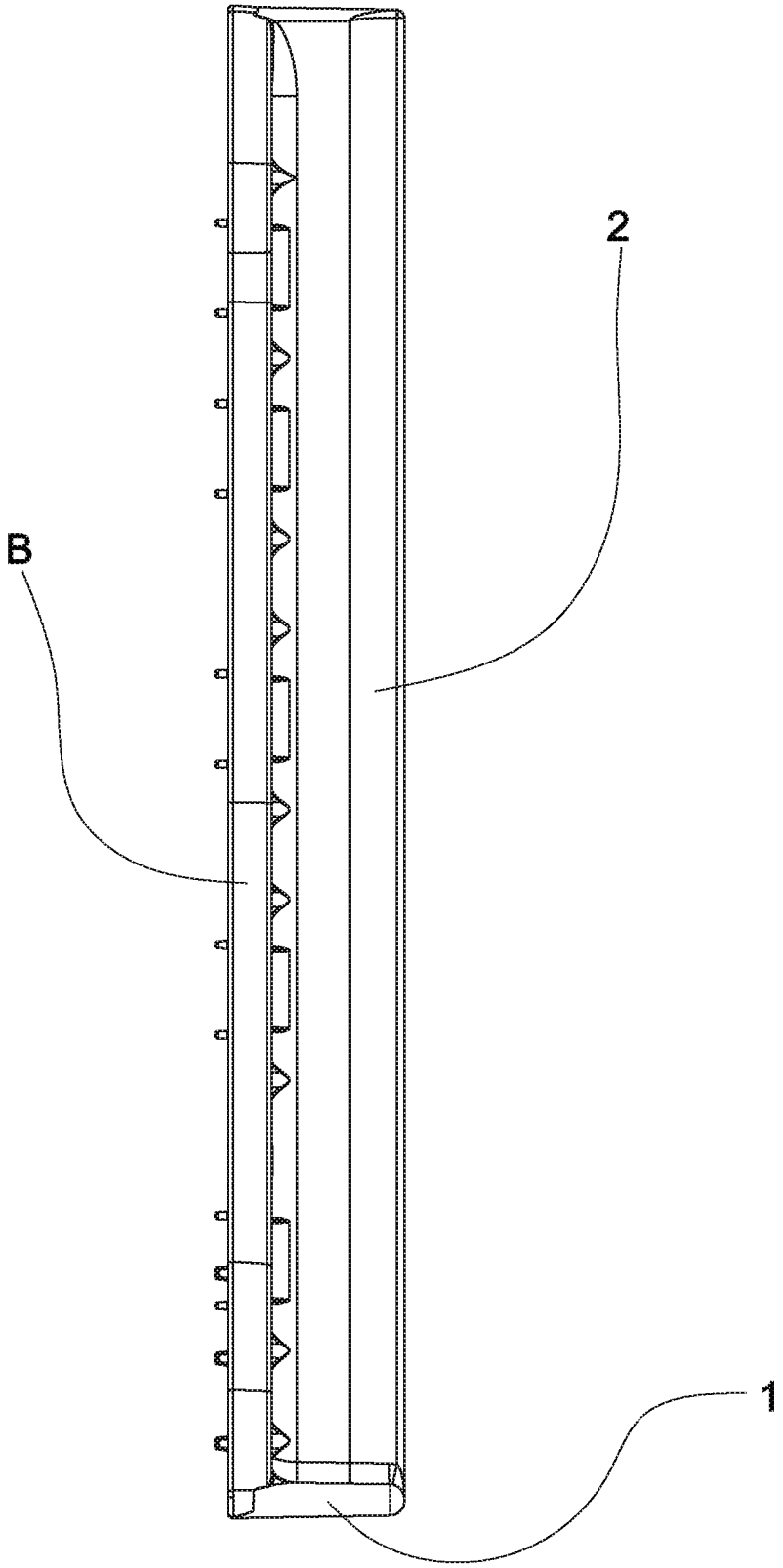
FIG. 5 illustrates the support in side view.

According to these illustrations, the present utility model: IMPROVEMENT IN SUPPORT FOR HOLDING CERAMIC FACING ELEMENTS ON A PALLET comprises an elongated rectangular and horizontal plate (1), in which top face and central region there is perpendicularly fixed an elongated rectangular and vertical plate (2), thus configuring an inverted "T" letter. Whereby, between the rear edges of both sides of the vertical plate (2) and the top rear edges of both sides of the horizontal plate (1) there are formed two respective walls (P), whereby each one is outwardly delimited by a sinuous and protruding edge (B), which protrusion projects horizontally towards the front of the support. In turn, all the area covered by the walls (P) is formed by a rigid mesh, which is comprised by a plurality of hollow interconnected rings (A), which present hexagonal shape, among other geometrical forms, configuring a beehive. And whereby, in the front face of both walls (P) there is formed a plurality of oblique protruding ribs (N), which extend from the region of the rear edges of the vertical plate (2) to the side edges (B).

The use of the present IMPROVEMENT IN SUPPORT FOR HOLDING CERAMIC FACING ELEMENTS ON A PALLET is extremely simple and practical. Whereby, when piling boxes of ceramic plates—or any other product packaged in boxes—on a pallet, there must be introduced a device—support—on each side of the pile of boxes, more precisely between two piles, so that, the horizontal plate (1) is fixed under the weight of the pile of boxes, while the vertical plate (2) is inserted between the vertical spaces existing between two piles of boxes, thus avoiding an easy movement of the piles.

Logically, the present IMPROVEMENT IN SUPPORT FOR HOLDING CERAMIC FACING ELEMENTS ON A PALLET can be constructed in several sizes and proportions, according to the sizes and proportions of the boxes to be piled on the pallets. Further, the elements can present variation in the geometrical shapes thereof, as well as their constitution (material), providing there are maintained the particular characteristics, which are essential to the embodiment thereof.

The invention claimed is:

1. A support for holding ceramic facing elements on a pallet, the support comprising:

(a) an elongated and horizontal rectangular plate having a top face and a central region defining two sides;

(b) an elongated and vertical plate, having two sides and perpendicularly fixed at the central region to the elongated and horizontal rectangular plate, configuring an inverted T-shape; and (c) two respective walls formed by a rigid mesh comprising a plurality of hollow interconnected hexagonal shape rings formed between rear edges of both sides of the elongated and horizontal plate and the rear edges of both sides of the elongated and vertical plate, wherein each of the two respective walls is outwardly delimited by a sinuous protruding edge that is horizontally projecting towards a front of the support, and wherein a plurality of protruding protrusions are obliquely placed on a front face of each of the two respective walls and extend from the rear edges of both of the sides of the elongated and vertical plate to the sinuous protruding edge.

* * * * *